US005582444A

United States Patent [19]

Hayakawa et al.

[11] Patent Number: 5,582,444

[45] Date of Patent: Dec. 10, 1996

[54] VEHICLE DOOR LOCK APPARATUS

[75] Inventors: Shigeru Hayakawa, Chiryu; Nozomu Torii, Hekinan; Masao Ohhashi, Kariya, all of Japan

[73] Assignee: Aisin Seiki Kabushiki Kaisha, Kariya, Japan

[21] Appl. No.: 312,900

[22] Filed: Sep. 27, 1994

[30] Foreign Application Priority Data

Sep. 29, 1993 [JP] Japan ..... 5-243051

[51] Int. Cl.[6] ..... E05C 3/06

[52] U.S. Cl. ..... 292/216; 292/DIG. 23; 292/DIG. 27

[58] Field of Search ..... 292/216, DIG. 23, 292/DIG. 27, 336.3, 337, 346

[56] References Cited

U.S. PATENT DOCUMENTS

| | | | |
|---|---|---|---|
| 3,129,026 | 4/1964 | Gergoe | 292/DIG. 27 |
| 5,005,882 | 4/1991 | Fukumoto | 292/216 |
| 5,046,769 | 9/1991 | Rimbey | 292/216 |
| 5,052,731 | 10/1991 | Hayakawa | 292/DIG. 27 |
| 5,308,128 | 5/1994 | Portelli | 292/DIG. 27 |
| 5,350,206 | 9/1994 | Akahori | 292/DIG. 23 |

FOREIGN PATENT DOCUMENTS

| | | |
|---|---|---|
| 3526501 | 2/1987 | Germany . |
| 2-125169 | 10/1990 | Japan . |
| 2178475 | 2/1987 | United Kingdom . |

*Primary Examiner*—Steven N. Meyers
*Assistant Examiner*—Gary Estremsky
*Attorney, Agent, or Firm*—Burns, Doane, Swecker & Mathis, LLP

[57] ABSTRACT

A vehicle door lock apparatus includes a base member for being fixed on a vehicle door, a latch mechanism mounted on the base member for engaging with and disengaging from a vehicle body, an open lever mounted on the base member for operating the latch mechanism through a connecting member, a locking lever mounted on the base member for operating the connecting member so as to connect and disconnect the open lever and the latch mechanism, a protect cover fixed on the base member which covers the locking lever and the connecting member and which includes an opening, a sub-open lever mounted on the base member so as to be located out of the protect cover and which is connected with the open lever through the opening and connecting portion for being connected with an operation member located at an outside of the vehicle which is disposed on the sub-open lever so as to be distant from the opening.

14 Claims, 4 Drawing Sheets

VEHICLE DOOR LOCK APPARATUS

BACKGROUND OF THE INVENTION

1. Field of the Invention

The present invention relates to a door lock apparatus, and more particularly to a vehicle door lock apparatus.

2. Description of the Related Art

A conventional vehicle door lock apparatus is disclosed in Japanese Utility Model Laid Open No. 2 (1990)-125169. The vehicle door lock apparatus disclosed in this document comprises a base member fixed in a vehicle door which is swingably mounted on a vehicle body, a latch mechanism including a latch member which is mounted on the base member and which can engage and disengage with a striker mounted on a vehicle body, a lift lever disposed on the base member operating the latch mechanism so as to disengage the striker and the latch mechanism, an open lever mounted on the base member for operating the lift lever through a slide bush, and a locking lever mounted on the base member for operating the slide bush so as to connect and disconnect the open lever and the lift lever.

In general the lift lever, the open lever, the locking lever and the slide bush are covered with a protecting cover that is fixed on the base member so that the locking lever, the slide bush and so on cannot be criminally operated. The protection cover includes an opening through which the open lever is connected with an operation member operating the open lever. Therefore, a wire or the like inserted into the vehicle door along the operation member and the open lever can be inserted from the opening to the locking lever and the slide bush in order to open the locked vehicle door and thereby steal the vehicle.

OBJECT AND SUMMARY OF THE PRESENT INVENTION

It is an object of the present invention to provide a vehicle door lock apparatus which can prevent a locked door from being opened by a vehicle thief.

It is another object of the present invention to provide a vehicle door lock apparatus which can be conveniently manufactured.

It is a further object of the present invention to provide a vehicle door lock apparatus which is durable.

It is a further object of the present invention to provide a vehicle door lock apparatus which is simple in structure and small in size.

It is a further object of the present invention to provide a vehicle door lock apparatus which is low in cost.

To achieve the above mentioned objects, a vehicle door lock apparatus in accordance with this invention comprises a base member for being fixed on a vehicle door, a latch mechanism mounted on the base member for engaging and disengaging with a vehicle body, an open lever mounted on the base member operating the latch mechanism through a connecting member, a locking lever mounted on the base member operating the connecting member so as to connect and disconnect the open lever and the latch mechanism, a protect cover fixed on the base member which covers the locking lever and the connecting member and which includes an opening, a sub-open lever mounted on the base member so as to be located out of the protect cover and which is connected with the open lever through the opening, and a connecting portion for being connected with an operation member located at an outside of the vehicle which is disposed on the sub-open lever so as to be distant from the opening.

BRIEF DESCRIPTION OF THE DRAWING FIGURES

The features and advantages of the vehicle door lock apparatus according to the present invention will be more clearly appreciated from the following description considered in conjunction with the accompanying drawing figures in which like elements bear like reference numerals and wherein.

DETAILED DESCRIPTION OF PREFERRED EMBODIMENT

Figure 1:
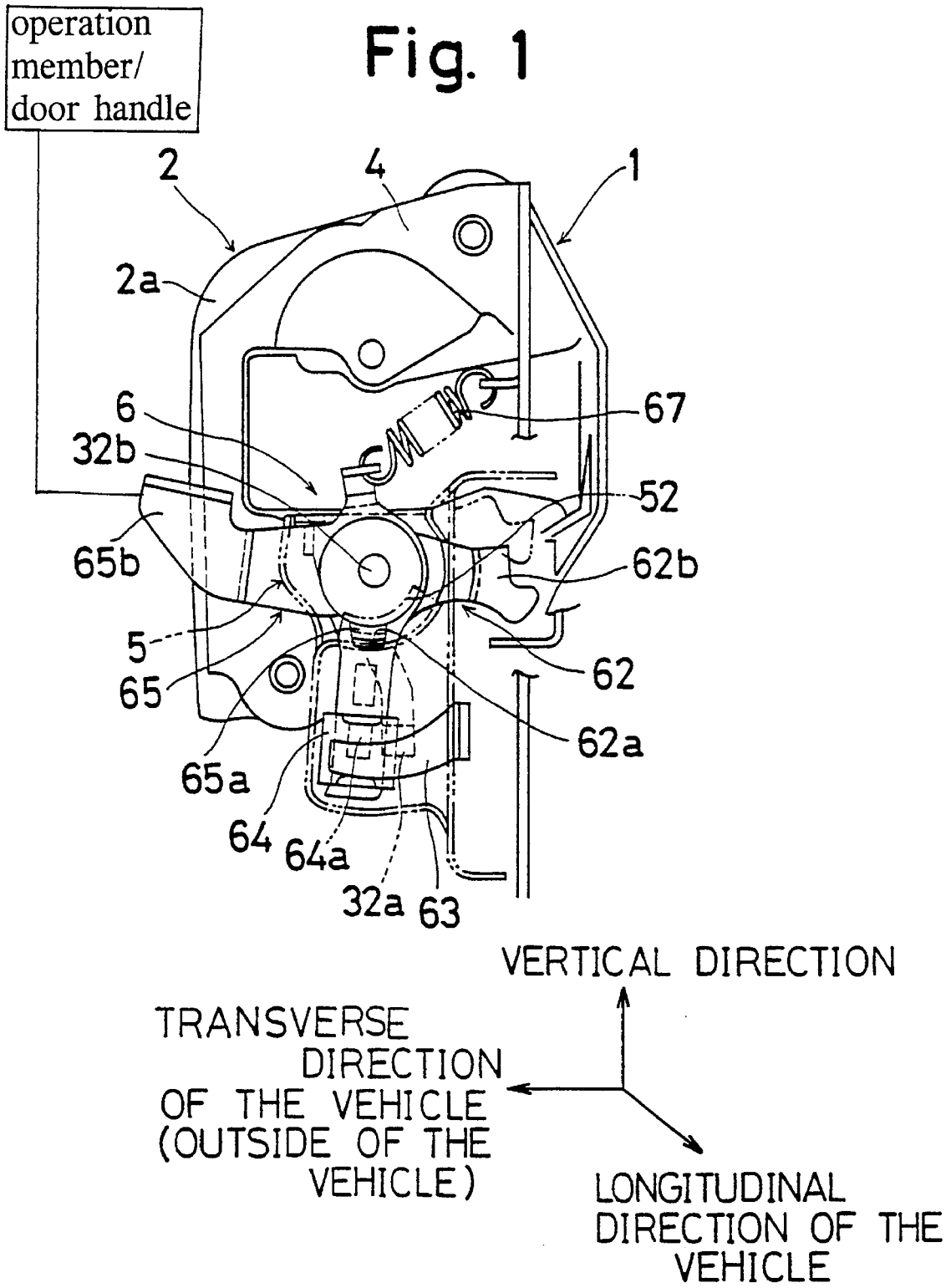
FIG. 1 is a plan view of a vehicle door lock apparatus of the present invention.
Figure 2:
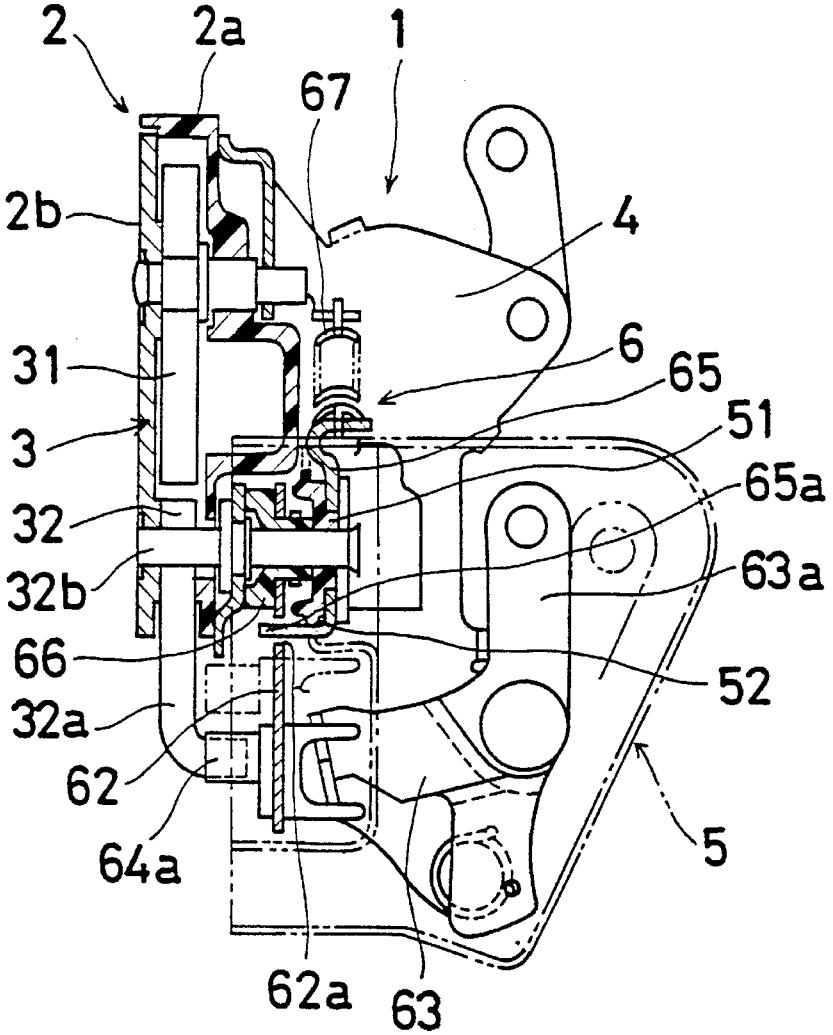
FIG. 2 is a longitudinal sectional view of a vehicle door lock apparatus shown in the FIG. 1.
Figure 2:
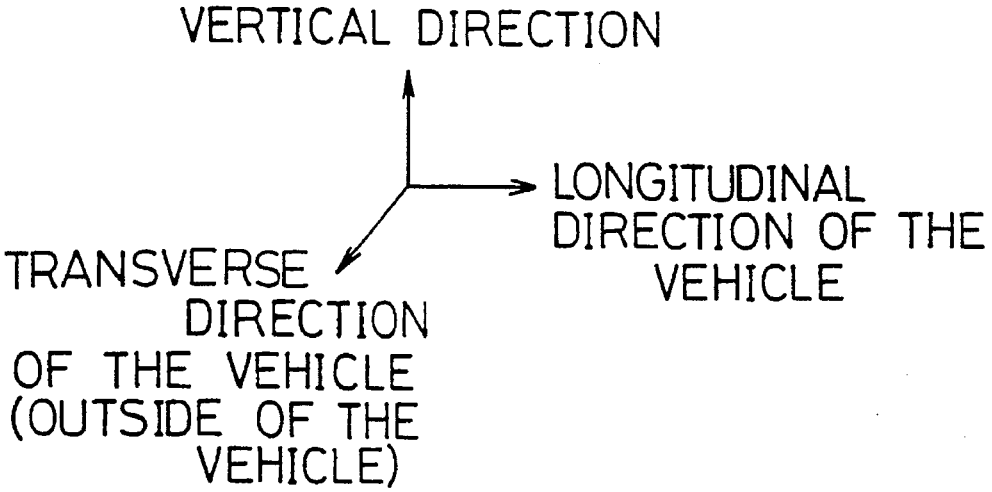

With reference to FIGS. 1 and 2, a vehicle door lock apparatus 1 comprises a housing 2 which is mounted on a vehicle door and which includes a body 2*a* and a cover 2*b*, a latch mechanism 3 installed in the housing 2, and a link mechanism 6 mounted on the housing 2.

Figure 3:
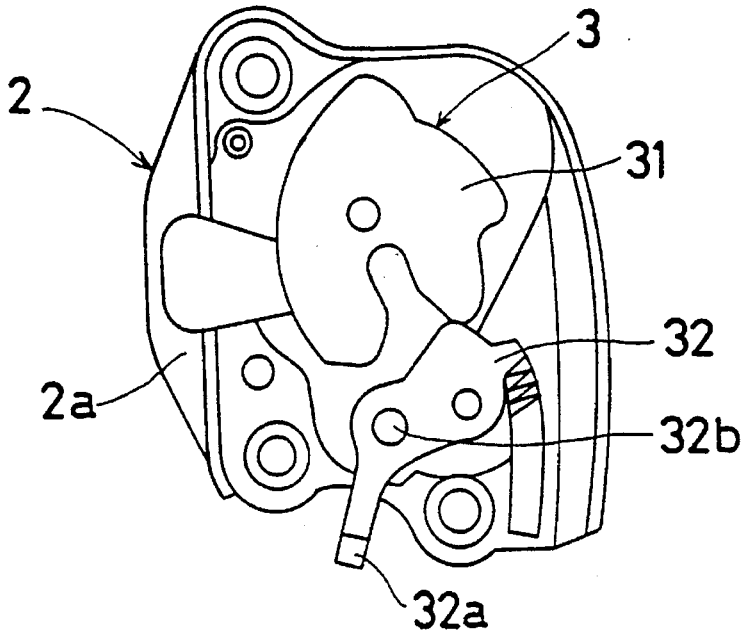
FIG. 3 is a plan view of a vehicle door lock apparatus of the present invention showing the latch mechanism.
Figure 5:
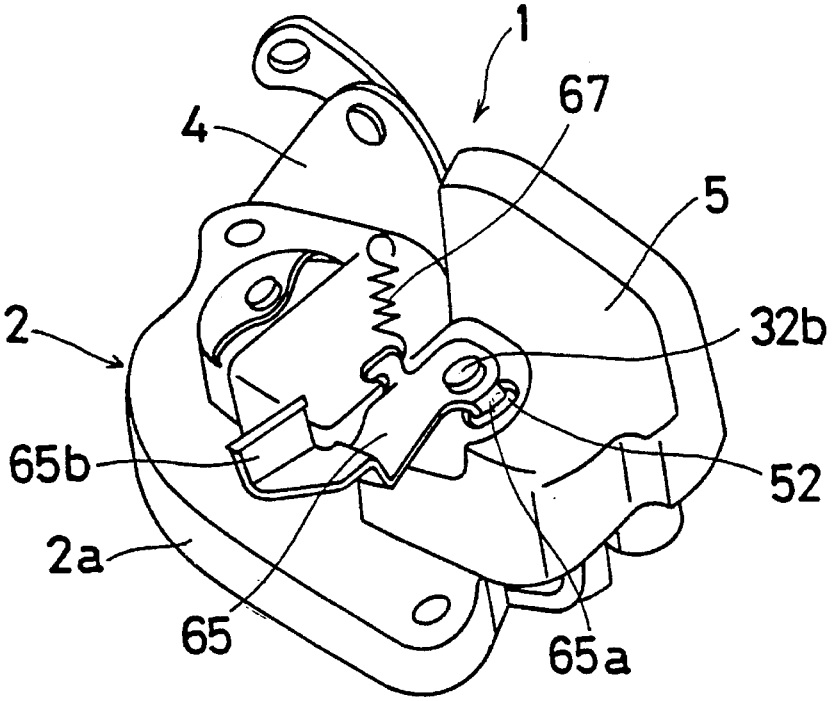
FIG. 5 is a perspective view of a vehicle door lock apparatus of the present invention.

As seen in FIGS. 2 and 3, the latch mechanism 3 is formed with a latch member 31 and a pawl member 32. The latch member 31 is rotatably supported on the body 2*a* so as to be engaged and disengaged with a striker (not shown in the drawing figures) mounted on a vehicle body. The striker pushes and pulls the latch member 31 in order to rotate the latch member 31 when the vehicle door is opened and closed. The pawl member 32, which includes a foot portion 32*a* extending out of the housing 2, is rotated by the operation of the link mechanism 6 and the rotation of the latch member 31 so as to be engaged with the latch member 31. When the latch member 31 and the pawl member 32 are engaged with each other, the vehicle door is kept from being closed (i.e., the Latch Condition of the vehicle door lock apparatus 1). On the other hand, when the latch member 31 is not engaged with the pawl member 32, the vehicle door can be operated for being opened and closed (i.e., the Unlatched Condition of the vehicle door lock apparatus 1). Details of the mounting construction and operation of the aforementioned latch member 31 and the pawl member 32 are conventional.

Figure 4:
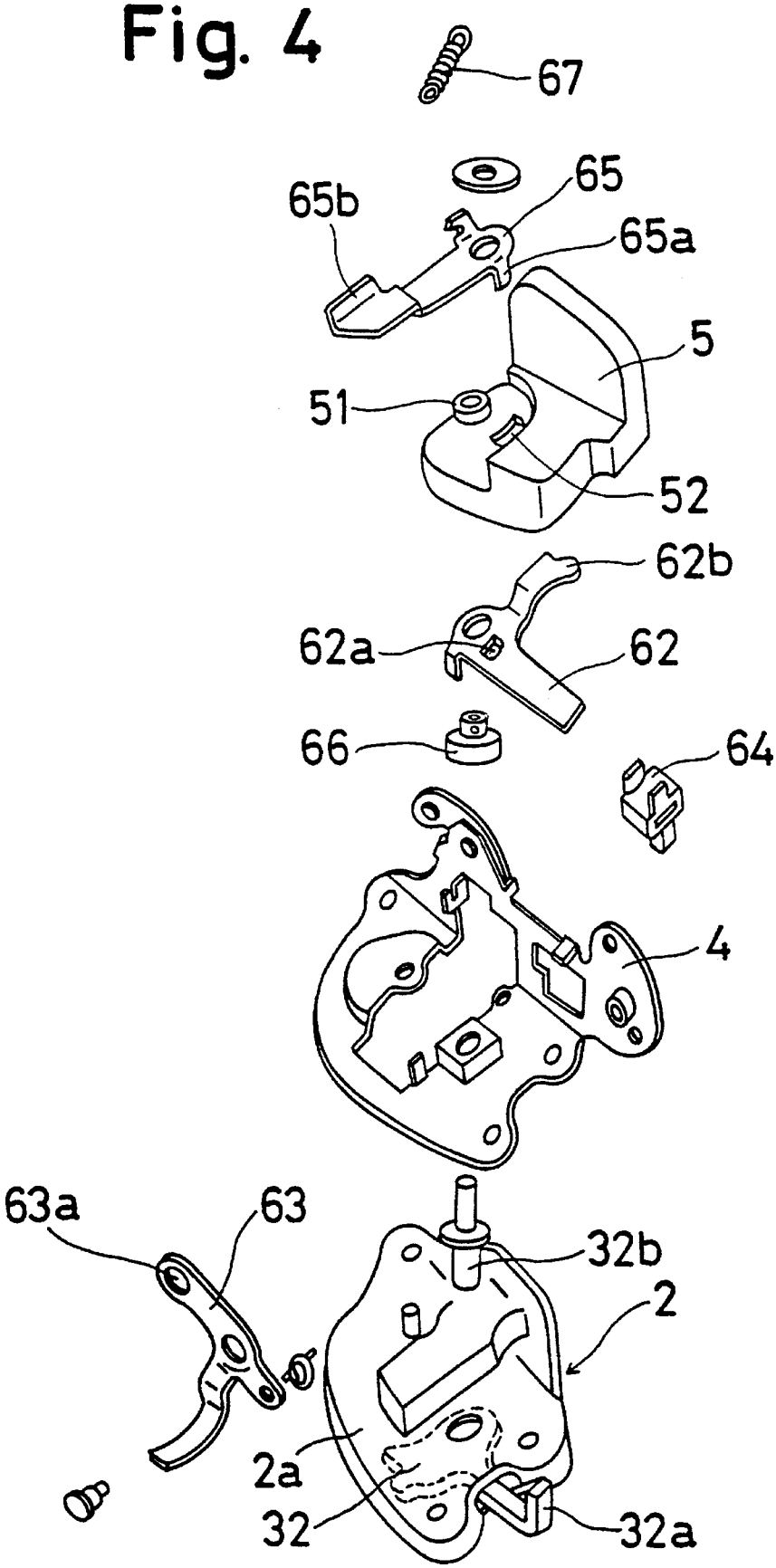
FIG. 4 is an exploded perspective view of a vehicle door lock apparatus shown in the FIG. 1.

As shown in the FIGS. 1, 2 and 4, the link mechanism 6 is formed with an open lever 62, a locking lever 63, a slide bush 64 (i.e., connecting member) and a sub-open lever 65. The open lever 62 is rotatably mounted on a pivot pin 32*b* supporting the pawl member 32 through a collar 66. The locking lever 63 is pivotably mounted on a plate 4 fixed to the housing 2. The slide bush 64 is slidably disposed on the open lever 62 and is engaged with the locking lever 63. The slide bush 64 includes a contacting portion 64*a* engaged and disengaged with the foot portion 32*a* of the pawl member 32 through sliding movement of the side bush 64. The sub-open lever 65 is rotatably supported around the pivot pin 32*b*. The sub-open lever 65 includes a flange 65*a* inserted into an opening 62*a* disposed on the open lever 62 so that the sub-open lever 65 is integrally rotated with the open lever 62.

When the foot portion 32*a* of the pawl member 32 is located at a position at which it can be engaged with the contacting portion 64*a* of the slide bush 64, the latch member 31 can be rotated in order that the vehicle door lock apparatus 1 is turned from the Latch Condition to the Unlatch Condition (i.e., the Unlock Condition of the vehicle door lock apparatus 1). On the other hand, when the foot portion 32*a* of the pawl member 32 is located at a position to not be engaged with the contacting portion 64*a* of the slide bush 64, the latch member 31 cannot be rotated in order that the vehicle door lock apparatus 1 cannot be turned from the Latch Condition to the Unlatch Condition (i.e., the Lock Condition of the vehicle door lock apparatus).

As shown in the FIGS. 1, 2, 4 and 5, a protect cover 5 is fixed on the housing 2. The protect cover 5 is mounted on the pivot pin 32*b* and covers the open lever 62, the locking lever 63 and the slide bush 64. On the other hand, the sub-open lever 65 is rotatably mounted on a boss portion 51 formed around the pivot pin 32*b* so as to be positioned out of the protect cover 5. The protect cover 5 further includes an opening 52 possessing an arch-shaped or arcuate configuration around the pivot pin 32*b*. The opening 62*a* of the open lever 62 and the flange 65*a* of the sub-open lever 65 are engaged with each other through the arch-shaped opening 52. The opening 52 opens in the longitudinal direction of the vehicle when the vehicle door lock apparatus 1 is mounted on the vehicle. The size of the opening 52 is exactly as large as the flange 65*a* is permitted to be moved by the rotation of the open lever 62 and the sub-lever 65, thereby being rather small.

The sub-open lever 65 includes a connecting portion 65*b* which is distant from the opening 52 of the protect cover 5 in the transverse direction of the vehicle. The connecting portion 65*b* is connected with an operation number located outside the vehicle, i.e. an outside handle (not shown in the drawing figures) disposed on the vehicle door through a rod and a lever and other known features. Further, both the locking lever 63 and the open lever 62 include connecting portions 63*a*, 62*b* with which each of a locking knob (not shown in the drawing figures) and an inside handle (not shown in the drawing figures) is connected through a rod and a lever and other known features.

As mentioned above, the connecting portion 65*b* of the sub-open lever 65 facing the outside of the vehicle cabin is distant from the opening 52 of the protect cover 5 when the vehicle door lock apparatus 1 is mounted on the vehicle. Therefore, a wire or the like inserted by a would-be thief into the vehicle door along the outside handle and the sub-open lever 65 cannot be inserted from the opening 52 to the locking lever 63 and the slide bush 64. Consequently, the locked vehicle door cannot be opened and the vehicle cannot be stolen.

Further, since the opening 52 is rather small and faces in the longitudinal direction of the vehicle, a wire or the like cannot be inserted into the vehicle door lock apparatus 1 from the opening 52. On the other hand, the protect cover 5 includes other openings through which each of the connecting portions 62*b* and 63*a* of the open lever 62 and the locking lever 63 is connected with each of the inside handle and the locking knob. However, because the connecting portions 62*b*, 63*a* face the inside of the vehicle cabin, a piece of wire or the like cannot be inserted from the outside into the vehicle door storing the vehicle door lock apparatus 1 along the inside handle, the locking knob, the open lever 62 and the locking lever 63.

The operation of the vehicle door lock apparatus 1 will be described below. When the latch member 31 is engaged with the pawl member 32 and the contacting portion 64*a* of the slide bush 64 is engageable with the foot portion 32*a* of the pawl member 32, the vehicle door lock apparatus I is under the Latch Condition and the Unlock Condition (i.e., the vehicle door is closed) as shown in FIGS. 1 to 3 by the full line. At this time, the contacting portion 64*a* of the slide bush 64 is engaged with the foot portion 32*a* of the pawl member 32 by rotation of the open lever 65 in the counter clock-wise direction as shown in FIG. 1 through the sub-open lever 62. This is caused by the operation of the inside handle or the outside handle. Therefore, the pawl member 32 is rotated so as to be disengaged from the latch member 31 (i.e., the Unlatch Condition of the vehicle door lock apparatus 1). In contrast, the vehicle door lock apparatus 1 is automatically turned from the Unlatched Condition to the Latch Condition when the vehicle door is closed.

When the vehicle door lock apparatus 1 is under the Unlock Condition as shown in the FIG. 1 by the full line, the slide bush 64 is slid in the upper direction by the rotation of the locking lever 63 in the clock-wise direction as shown in FIG. 2. This results from pressed operation of the locking knob in the vehicle. Therefore, the contacting portion 64*a* of the slide bush 64 is positioned out of a path which makes it engageable with the foot portion 32*a* of the pawl member 32 (i.e., the Lock Condition of the vehicle door lock apparatus 1).

A spring member 67 is disposed between the sub-open lever 65 and the plate 4 so as to force the open lever 62 and the sub-open lever 65 to each of the initial positions.

In the above embodiment, the foot portion 32*a* is able to be engaged and disengaged with the contacting portion 64*a*. However, a lift lever which is disposed on the pivot pin 32*b* and which is interlocked with the pawl member 32 may be engaged and disengaged with the contacting portion 64*a* of the slide bush 64. In this case the lift lever is covered with the protect cover 5.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock apparatus comprising:

a base member for being fixed on a vehicle door;

a latch mechanism mounted on the base member for engaging and disengaging a vehicle body;

an open lever mounted on the base member for operating the latch mechanism through a connecting member which is slidably mounted on the open lever;

a locking lever mounted on the base member for operating the connecting member so as to connect and disconnect the open lever and the latch mechanism;

a protect cover fixed on the base member which covers the locking lever and the connecting member and which includes an opening;

a sub-open lever having a mounting portion integrally formed therewith for rotatably mounting the sub-open lever with respect to the protect cover, said mounting portion being positioned exteriorly of the protect cover, said sub-open lever being connected with the open lever through the opening; and a connecting portion disposed on the sub-open lever at a position distant from the opening, said connecting portion being connectable to an operation member located outside the vehicle.

2. A vehicle door lock apparatus as recited in claim 1, wherein the connecting member includes a slide bush slidably positioned on an arm of the open lever.

3. A vehicle door lock apparatus mounted on a vehicle having a longitudinal extent comprising:

a base member for fixed on a vehicle door;

a latch mechanism mounted on the base member for engaging and disengaging a vehicle body;

an open lever mounted on the base member for operating the latch mechanism through a connecting member;

a locking lever mounted on the base member for operating the connecting member so as to connect and disconnect the open lever and the latch mechanism;

a protect cover fixed on the base member which covers the locking lever and the connecting member and which includes an opening, said opening facing in the direction of the longitudinal extent of the vehicle;

a sub-open lever having a mounting portion positioned exteriorly of the protect cover, said sub-open lever being connected with the open lever through the opening; and a connecting portion disposed on the sub-open lever at a position distant from the opening, said connecting portion being connectable to an operation member located outside the vehicle.

4. A vehicle door lock apparatus as cited in claim 3, wherein the sub-open lever is connected with the open lever by way of a flange extending from the sub-open lever and extending through the opening in the protect cover, the flange on the sub-open lever engaging an opening in the open lever.

5. A vehicle door lock apparatus as recited in claim 3, wherein said open lever is mounted on said pivot pin, said pivot pin extending through a boss portion on the protect cover.

6. A vehicle door lock apparatus as recited in claim 3, wherein the connecting member includes a slide bush slidably positioned on an arm of the open lever.

7. A vehicle door lock apparatus comprising:

a base member for being fixed on a vehicle door;

a latch mechanism mounted on the base member for engaging and disengaging a vehicle body;

an open lever for operating the latch mechanism through a connecting member that is slidably mounted on the open lever, said open lever being rotatably mounted on a pivot pin which has a longitudinal axis;

a locking lever operatively associated with the connecting member for operating the connecting member so as to connect and disconnect the open lever and the latch mechanism;

a protect cover fixed on the base member which covers the locking lever and the connecting member, said protect cover having a wall through which extends the longitudinal axis of said pivot pin, said wall being provided with an opening;

a sub-open lever rotatably mounted on the protect cover and positioned exteriorly of the protect cover, said sub-open lever including a flange extending transversely from a portion of the sub-open lever and extending through said opening, said flange being engaged with the open lever so that rotation of the sub-open lever causes rotation of the open lever; and a connecting portion disposed on the sub-open lever, said connecting portion being connectable to an operation member located outside the vehicle.

8. A vehicle door lock apparatus as recited in claim 7, wherein the connecting member is a slide bush.

9. A vehicle door lock apparatus as cited in claim 7, wherein the flange extending from the sub-open lever extends into an opening in the open lever.

10. A vehicle door lock apparatus as recited in claim 7, wherein said pivot pin extends through a boss portion on the protect cover.

11. A vehicle door lock apparatus as recited in claim 7, wherein said sub-open lever includes a mounting portion for rotatably mounting the sub-open lever, the mounting portion being located exteriorly of the protect cover.

12. A vehicle door lock apparatus as recited in claim 11, wherein said mounting portion of said sub-open lever is rotatably mounted on a boss provided on said wall of the protect cover.

13. A vehicle door lock apparatus comprising:

a base member for being fixed on a vehicle door;

a latch mechanism mounted on the base member for engaging and disengaging a vehicle body, said latch mechanism including a pivot pin;

an open lever mounted on the base member for operating the latch mechanism through a connecting member;

a locking lever mounted on the base member for operating the connecting member so as to connect and disconnect the open lever and the latch mechanism;

a protect cover fixed on the base member which covers the locking lever and the connecting member and which includes an opening, said pivot pin extending through a wall of the protect cover;

a sub-open lever having a mounting portion at which the sub-open lever is rotatably mounted for rotational movement with respect to the pivot pin, said mounting portion being positioned exteriorly of the protect cover, said sub-open lever being connected with the open lever through the opening; and a connecting portion disposed on the sub-open lever at a position distant from the opening, said connecting portion being connectable to an operation member located outside the vehicle.

14. A vehicle door lock apparatus as recited in claim 13, wherein said sub-open lever is rotatably mounted on a boss provided on the protect cover.

* * * * *